US007460811B2

(12) United States Patent
Mochizuki

(10) Patent No.: US 7,460,811 B2
(45) Date of Patent: Dec. 2, 2008

(54) IMAGE FORMING APPARATUS

(75) Inventor: Jun Mochizuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 11/668,160

(22) Filed: Jan. 29, 2007

(65) Prior Publication Data

US 2007/0201898 A1 Aug. 30, 2007

(30) Foreign Application Priority Data

Feb. 23, 2006 (JP) ..... 2006-046161

(51) Int. Cl.

| | |
|---|---|
| ***G03G 15/16*** | (2006.01) |
| ***G03G 15/01*** | (2006.01) |
| ***G03G 15/20*** | (2006.01) |
| ***G03G 21/00*** | (2006.01) |

(52) U.S. Cl. ..... 399/101; 399/302; 399/313; 399/350

(58) Field of Classification Search ..... 399/101, 399/302, 308, 313, 343, 350, 351
See application file for complete search history.

(56) References Cited

U.S. PATENT DOCUMENTS 5,450,185 A * 9/1995 Kuribayashi et al. ..... 399/350
2002/0186989 A1 12/2002 Nishimura et al. ..... 399/297
2003/0108360 A1* 6/2003 Ogasawara ..... 399/159

FOREIGN PATENT DOCUMENTS

| | | |
|---|---|---|
| JP | 10-186955 | 7/1988 |
| JP | 64-13574 | 1/1989 |
| JP | 6-11001 | 1/1994 |
| JP | 9-222804 | 8/1997 |
| JP | 2003-149953 | 5/2003 |
| JP | 2004-252028 | 9/2004 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes: an image bearing member which is rotated while bearing a toner image; an intermediate transfer belt onto which the toner image is primary-transferred from the image bearing member and which secondary-transfers the toner image onto a recording material; an image bearing member cleaning member which removes the toner from the image bearing member and in which a length of the image bearing member in a rotational axial direction is shorter than the image bearing member; and a bending member which is come into contact with a surface of the intermediate transfer belt onto which the toner image is primary-transferred and which bends the intermediate transfer belt, wherein, in the rotational axial direction of the image bearing member, assuming that a length of the image bearing member cleaning member is set to Ldrcln, a length of the intermediate transfer belt is set to Lb, and a length of the bending member is set to Lr, there is a relation of Lb>Ldrcln>Lr.

6 Claims, 5 Drawing Sheets

IMAGE FORMING APPARATUS

BACKGROUND OF THE INVENTION

1. Field of the Invention

The present invention relates to an image forming apparatus for primary-transferring a toner image formed on an image bearing member onto a rotating intermediate transfer material, secondary-transferring the primary transfer image onto a recording material, and forming an image. More particularly, the invention relates to an image forming apparatus for bending the intermediate transfer material from an outer peripheral surface on which the toner image has been held to an inner peripheral surface by a bending member.

2. Description of the Related Art

In recent years, in an electrophotographic apparatus, a requirement for realization of a high picture quality, a high durability, low costs, a full color, and the like from the market has been increasing. Particularly, in recent years, the realization of a full color of documents in an office is being progressed owing to the spread of a color printer and a color copying apparatus and a requirement to realize an apparatus which outputs a full color image at a speed similar to that of a monochromatic image is increasing.

To satisfy such a requirement, an attention is paid to what is called a tandem type full color image forming apparatus. The tandem type image forming apparatus is an apparatus constructed in such a manner that a plurality of photosensitive bodies are arranged, each of the photosensitive bodies individually has a developing apparatus, a monochromatic toner image is formed onto each of the photosensitive bodies, and the monochromatic toner images are transferred and sequentially overlaid, thereby recording a synthetic color image onto a recording material.

In the tandem type image forming apparatus, a printing speed can be fairly raised and a printing time can be remarkably reduced as compared with those of what is called a one-drum type image forming apparatus which forms the synthetic full color image onto the photosensitive body by repeating the image forming operation a plurality of number of times (ordinarily, four times) by using one photosensitive body. However, since such a tandem type image forming apparatus has a plurality of image forming portions, the apparatus is liable to be enlarged in size.

The tandem type image forming apparatuses are classified into a direct transfer type and an intermediate transfer type. According to the direct transfer type, images on the photosensitive bodies are sequentially and directly transferred onto a sheet which is conveyed by a recording material conveying belt by a transfer apparatus. According to the intermediate transfer type, after the images on the photosensitive bodies are temporarily sequentially transferred onto an intermediate transfer belt by a primary transfer apparatus, the images on the intermediate transfer belt are transferred onto a recording material in a lump by a secondary transfer apparatus.

According to the intermediate transfer type, since a secondary transfer position can be relatively freely set and it is of advantage to prevention of a contamination of the photosensitive bodies because the recording material is not come into contact with the photosensitive bodies. Therefore, an attention has particularly been paid to the intermediate transfer type in recent years.

As an apparatus using such an intermediate transfer type, there has been proposed an image forming apparatus in which a bending member for pressing an intermediate transfer belt from an outer peripheral surface is provided on the downstream side of a secondary transfer position and on the upstream side of a primary transfer position in the moving direction of the intermediate transfer belt (refer to Japanese Patent Application Laid-Open No. H09-222804).

In such an image forming apparatus, the intermediate transfer belt is pressed inwardly by the bending member and a path is changed so that the belt is indented inwardly, thereby forming an empty space on the outside thereof. Since another apparatus can be arranged in such an empty space, the whole image forming apparatus can be miniaturized.

In the image forming apparatus using such a bending member, when toner leaked from both edge portions of an intermediate transfer belt cleaning member is come into contact with the belt in the pressed state between the intermediate transfer belt and the bending member, the toner is fixed to the bending member and there is a risk that the intermediate transfer belt is damaged.

On the other hand, as illustrated in FIG. 8, there has been proposed a construction in which for an intermediate transfer belt 100 which is suspended around suspending rollers 103 and is rotatable in the direction shown by arrows, an intermediate transfer belt cleaning member 101 and a bending member 102 are provided on the downstream side of a secondary transfer position and on the upstream side of a primary transfer position, and a length of bending member 102 in the width direction is set to be shorter than that of the intermediate transfer belt cleaning member 101 in the width direction (refer to Japanese Patent Application Laid-Open No. 2003-149953).

However, the above construction in which the width of bending member 102 is set to be shorter than that of the intermediate transfer belt cleaning member 101 has the following problem.

That is, since the width of bending member 102 is smaller than that of the intermediate transfer belt cleaning member 101, the width of bending member 102 is fairly shorter than that of the intermediate transfer belt 100. Thus, in edge portions of the bending member 102, such a phenomenon that the intermediate transfer belt 100 falls to the side of the bending member 102 by a tension of the intermediate transfer belt 100 occurs or wrinkles of the intermediate transfer belt 100 are liable to occur due to a concentration of stresses on the edge portions of the bending member 102.

Therefore, in the edge portions of the intermediate transfer belt cleaning member 101, the contact state of the intermediate transfer belt 100 and the intermediate transfer belt cleaning member 101 becomes unstable and a defective cleaning is liable to occur.

As a result of various studies, it has been found that the toner fouling of the edge portions of the intermediate transfer belt 100 is not always caused only by the toner leaked from both of the edge portions of the intermediate transfer belt cleaning member 101 disclosed in Japanese Patent Application Laid-Open No. 2003-149953. Rather than the leaked toner, the toner accumulated in the edge portions of the photosensitive drum is transferred onto the intermediate transfer belt 100, so that the toner fouling is accumulated.

In the image forming apparatus, a developing apparatus and a photosensitive drum cleaner are arranged around a photosensitive drum. In addition to the toner leaked from both edge portions of the photosensitive drum cleaner in the longitudinal direction, the toner scattered from the developing apparatus and the like are accumulated in both edge portions of the photosensitive drum in the longitudinal direction and a belt of the toner fouling is formed due to the durability of a long period of time. The photosensitive drum cleaner is set so as to be shorter than the photosensitive drum in order to stabilize the contact of the photosensitive drum cleaner with the photosensitive drum.

Since the toner fouling of the edge portions of the photosensitive drum is come into contact with the intermediate transfer belt 100, the belts of the toner fouling formed in the edge portions of the photosensitive drum are transferred and deposited onto the edge portions of the intermediate transfer belt 100. If the toner fouling of the edge portions of the intermediate transfer belt formed as mentioned above is come into contact with the belt in the pressed state between the intermediate transfer belt 100 and the bending member 102, the toner is fixed and deposited onto the bending member 102 as mentioned above and there is a risk that the intermediate transfer belt 100 is damaged.

SUMMARY OF THE INVENTION

It is an object of the invention to provide an image forming apparatus which can avoid a toner fouling formed in an image bearing member edge portion from being transferred to a bending member through an intermediate transfer material.

Another object of the invention is to provide an image forming apparatus comprising: an image bearing member which is rotated while bearing a toner image; an intermediate transfer belt onto which the toner image is primary-transferred from the image bearing member and from which the toner image is secondary-transferred onto a recording material; an image bearing member cleaning member which removes the toner from the image bearing member and whose length of the image bearing member in the rotational axial direction of the image bearing member is shorter than the image bearing member; and a bending member which comes into contact with the surface of the intermediate transfer belt onto which the toner image is primary-transferred and which bends the intermediate transfer belt, wherein in the rotational axial direction of the image bearing member, assuming that a length of the image bearing member cleaning member is set to Ldrcln, a length of the intermediate transfer belt is set to Lb, and a length of the bending member is set to Lr, there is a relation of Lb>Ldrcln>Lr.

Further features of the present invention will become apparent from the following description of exemplary embodiments with reference to the attached drawings.

DESCRIPTION OF THE EMBODIMENTS

An image forming apparatus according to an embodiment of the invention will now be described.

Figure 2:
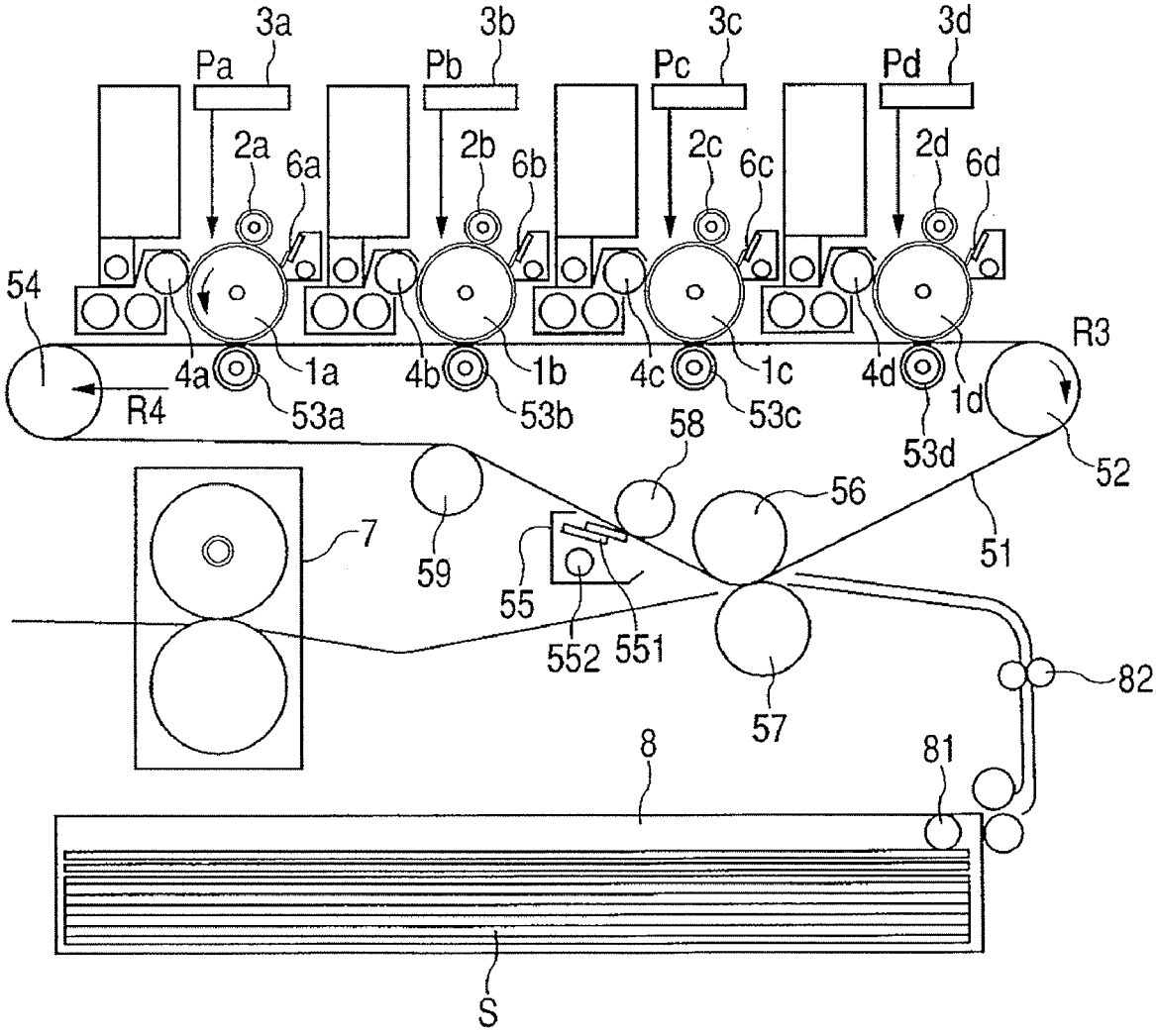
FIG. 2 is a schematic constructional diagram of the image forming apparatus of the first embodiment.

FIG. 2 is a cross sectional explanatory diagram illustrating an outline of the image forming apparatus according to the embodiment of the invention. The image forming apparatus of the embodiment is a full color electrophotographic image forming apparatus of a tandem type having four photosensitive drums and using an intermediate transfer material.

[Whole Construction of Image Forming Apparatus]

First, a whole construction of the image forming apparatus will be briefly described together with the image forming operation with reference to FIG. 2. The image forming apparatus of the embodiment forms a color image by an electrophotographic system.

In the image forming apparatus, four processing units are arranged almost horizontally. That is, processing units Pa, Pb, Pc, and Pd for forming toner images of colors of yellow, magenta, cyan, and black are arranged in order from the left side in FIG. 2. The processing units have substantially the same construction except that the colors of toner are different. Therefore, reference characters a, b, c, and d attached to respective reference numerals in the diagram are omitted and an explanation will be made.

A primary charging unit 2, a developing apparatus 4, and a drum cleaner 6 are arranged around a photosensitive drum 1 in each processing unit P. A scanner unit 3 for irradiating a laser beam in accordance with an image signal is arranged over the photosensitive drum 1.

An intermediate transfer belt 51 as an intermediate transfer material is rotatably provided so as to be come into contact with each photosensitive drum 1. A primary transfer roller 53 is provided at an opposite position of the photosensitive drum 1 so as to sandwich the intermediate transfer belt 51.

When an image is formed, the surface of the photosensitive drum 1 which is rotated counterclockwise is uniformly charged by the primary charging unit 2. The laser beam corresponding to the image signal is irradiated from the scanner unit 3 and an electrostatic latent image is formed. This latent image is developed with toner by the developing apparatus 4 and visualized.

The toner image is primary-transferred onto the intermediate transfer belt 51 by applying a bias voltage to the primary transfer roller 53. The toner images of the colors of yellow, magenta, cyan, and black formed by the image forming stations are overlaid and transferred onto the intermediate transfer belt 51, so that a color image is formed. By applying a bias voltage to a secondary transfer outer roller 57 in a secondary transfer section serving as an image recording section, the color image is secondary-transferred and recorded onto a recording material S which is conveyed from a feeding cassette 8 by a pickup roller 81 and a conveying roller 82.

The recording material onto which the toner image has been transferred is guided to a fixing apparatus 7 and heat and a pressure are applied to the toner image, so that the toner image is fixed onto the recording material. After that, the recording material is ejected to the outside of the image forming apparatus.

Figure 3:
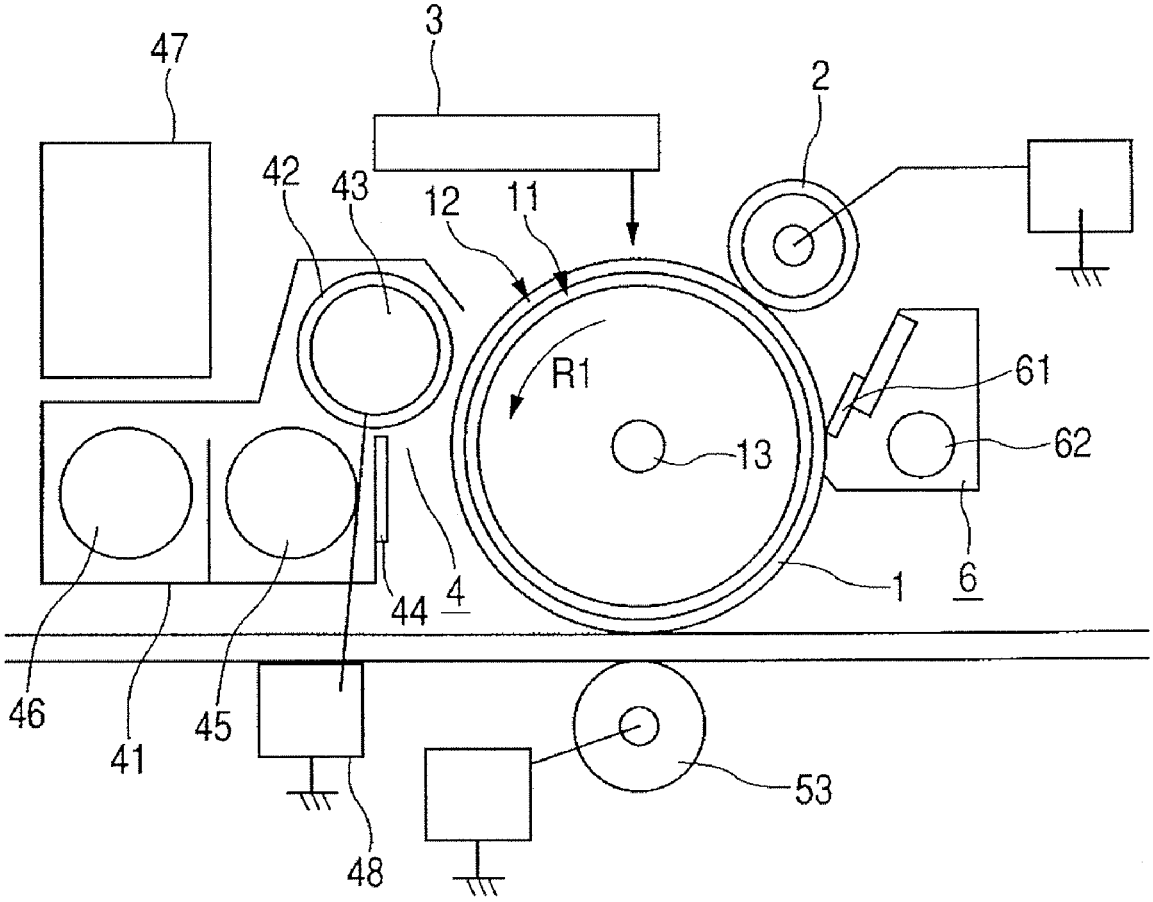
FIG. 3 is a schematic constructional diagram of a processing unit of the image forming apparatus of the first embodiment.

A construction of each section of the processing unit P will now be described. As illustrated in FIG. 3, the processing unit P has the photosensitive drum 1 as an image bearing member which has rotatably been supported. The photosensitive drum 1 is a cylindrical OPC photosensitive body which is fundamentally constructed by a conductive base material 11 made of aluminum and a photoconductive layer 12 formed around the outer periphery of the conductive base material 11. The photosensitive drum 1 has a supporting axis 13 at the center and is rotated by driving means (not shown) in the direction shown by an arrow R1 around the supporting axis 13 as a rotational center.

The charging roller 2 as charging means is arranged over the photosensitive drum 1. The charging roller 2 is come into contact with the surface of the photosensitive drum 1 and uniformly charges the surface to an electric potential of a negative polarity. The whole charging roller 2 is formed in a roll shape.

The developing apparatus 4 has a developer container 41 in which a developer of two components has been enclosed. A developing sleeve 42 is rotatably arranged in an opening portion of the developer container 41 which faces the photosensitive drum 1. A magnet roller 43 for holding the developer onto the developing sleeve 42 is fixedly arranged in the developing sleeve 42 so as not to be rotated in association with the rotation of the developing sleeve 42. A regulating blade 44 for regulating the developer held on the developing sleeve 42 and forming a thin developer layer is attached to a lower position of the developing sleeve 42 of the developer container 41. Further, a developing chamber 45 and an agitating chamber 46 which have been partitioned are provided in the developer container 41. A supplementing chamber 47 in which the supplementary toner has been enclosed is provided over the developer container 41.

Upon developing, the developer layer is formed on the developing sleeve 42. By applying a developing bias voltage to the developing sleeve 42 from a power source 48, the electrostatic latent image formed on the photosensitive drum 1 is developed as a toner image.

The photosensitive drum cleaner (image bearing member cleaning member) 6 is constructed by a photosensitive drum cleaner blade 61 and a conveying screw 62. The photosensitive drum cleaner blade 61 is come into contact with the photosensitive drum 1 at predetermined angle and pressure by pressing means (not shown) and collects the toner remaining on the surface of the photosensitive drum 1. The collected residual toner is conveyed and ejected by the conveying screw 62.

[Intermediate Transfer Belt and Cleaner]

The intermediate transfer belt 51 is made of a dielectric resin such as PC, PET, or PVDF. In the embodiment, a PI resin having a volume resistivity of 108 Ω·cm (a probe which conforms with the JIS-K6911 rule is used: applied voltage is 100V, applying time is 60 sec. 23° C., 50% RH) and a thickness of t (=100 μm) is used. Another material of different volume resistivity and thickness may be used.

The intermediate transfer belt 51 is suspended by a driving roller 52, a tension roller 54, a secondary transfer inner roller 56, and the like. The intermediate transfer belt 51 is rotated in the direction shown by an arrow R3 in FIG. 2 by the driving roller 52. A predetermined tension (5 kg in the embodiment) is applied to the intermediate transfer belt 51 in the direction shown by an arrow R4 by the tension roller 54.

The transfer residual toner on the intermediate transfer belt 51 is removed and collected by an intermediate transfer belt cleaner 55. The intermediate transfer belt cleaner 55 is constructed by an intermediate transfer belt cleaner blade 551 and a conveying screw 552. The intermediate transfer belt cleaner blade 551 is come into contact with the intermediate transfer belt 51 at predetermined angle and pressure by the pressing means (not shown) and collects the toner remaining on the surface of the intermediate transfer belt 51. The collected residual toner is conveyed and ejected by the conveying screw 552. An intermediate transfer belt cleaner facing roller 58 is provided to allow the intermediate transfer belt 51 and the intermediate transfer belt cleaner blade 551 to be stably come into contact with each other.

Further, a press-bending roller 59 serving as a bending member (pressing member) for pressing the intermediate transfer belt 51 from the outer peripheral surface and bending the intermediate transfer belt 51 from the outer peripheral surface to the inner peripheral surface is provided on the downstream of the intermediate transfer belt cleaner 55 in the moving direction of the intermediate transfer belt 51. Since the press-bending roller 59 is arranged on the downstream of the intermediate transfer belt cleaner 55, a fouling due to the transfer residual toner in the secondary transfer section can be avoided. The bending roller 59 is arranged on the upstream side of the primary transfer section for transferring the toner image onto the intermediate transfer belt 51 by the photosensitive drum 1. The bending roller 59 is made of a metal such as one of SUS, aluminum, a resin, and rubber. In the embodiment, a roller made of SUS having a diameter of 20 mmϕ is used as a bending roller 59.

[Relation Among the Lengths of Members]

A relation among the lengths of the respective members in the width direction which perpendicularly crosses the moving direction of the intermediate transfer belt 51 as a characteristic construction of the embodiment will now be described.

It is an object of the image forming apparatus of the embodiment to avoid such a phenomenon that since the toner fouling formed in the edge portions of the photosensitive drum is transferred to the bending roller through the intermediate transfer belt, the intermediate transfer belt is damaged. For this purpose, the inventors examined the relation among the lengths of the respective members and found that such a problem can be avoided by specifying the relation among the lengths of the respective members as follows.

Figure 1:
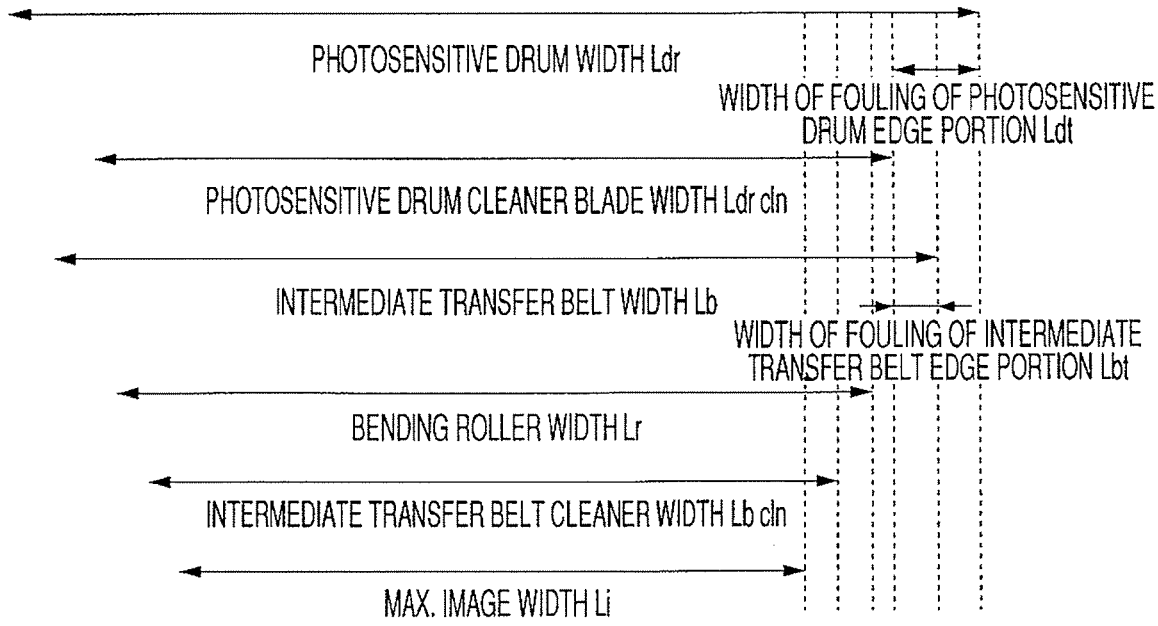
FIG. 1 is a diagram illustrating relations among widths of members of an image forming apparatus of the first embodiment.

FIG. 1 illustrates the relation among a length Ldr in the width direction of the photosensitive drum, a length Ldrcln in the width direction of the photosensitive drum cleaner blade, a length Lb in the width direction of the intermediate transfer belt, a length Lr of bending roller, and a length Lbcln in the width direction of intermediate transfer belt cleaner blade 551. The "length in the width direction" is simply referred to as "width" hereinbelow.

In FIG. 3, the image on the surface of the photosensitive drum 1 developed by the developing apparatus 4 is transferred onto the intermediate transfer belt 51 by the primary transfer roller 53. The transfer residual toner on the surface of the photosensitive drum 1 is collected by the photosensitive drum cleaner 6. At this time, in the edge portions of the photosensitive drum 1, a belt-shaped toner fouling is formed by the deposition of the scattered toner near the developing apparatus 4 and the toner leaked from both edge portions of the photosensitive drum cleaner blade 61. As illustrated in FIG. 1, a width Ldt of fouling in the edge portions of the photosensitive drum is illustrated by a difference between the width Ldr of photosensitive drum and the width Ldrcln of photosensitive drum cleaner blade.

Figure 4:
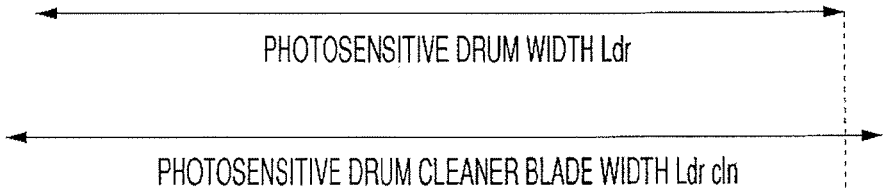
FIG. 4 is a diagram illustrating a relation between the widths of the members of the image forming apparatus.

If a width of photosensitive drum cleaner blade 61 is set to be larger than that of the photosensitive drum 1 which faces it (refer to FIG. 4), the belt-shaped toner fouling is not formed. However, since the facing members of the edge portions of the photosensitive drum cleaner blade 61 do not exist, it becomes a cause of peel-off from the edge portions of the photosensitive drum cleaner blade 61 or a defective cleaning.

Therefore, it is possible to set the width Ldrcln of photosensitive drum cleaner blade 61 to be smaller than the width Ldr of photosensitive drum 1. That is, it is necessary to satisfy the following relation.

(width Ldr of photosensitive drum)>(width Ldrcln of photosensitive drum cleaner blade)

Further, the case where the belt-shaped toner fouling in the edge portions of the photosensitive drum 1 is come into contact with the intermediate transfer belt 51 and transferred and fixed thereon is limited to the case where the width of intermediate transfer belt 51 is larger than the width of photosensitive drum cleaner blade 61, that is, the following case.

(width Lb of intermediate transfer belt)>(width Ldrcln of photosensitive drum cleaner blade)

Figure 5:
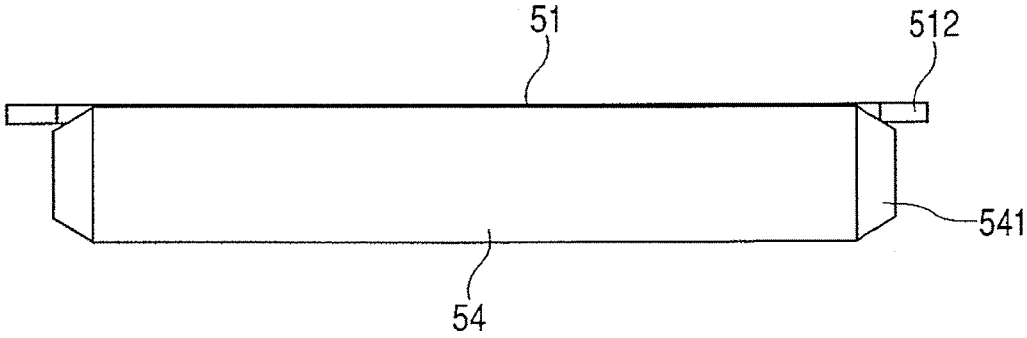
FIG. 5 is a diagram illustrating a construction of deviation regulation of an intermediate transfer belt in the first embodiment.
Figure 6:
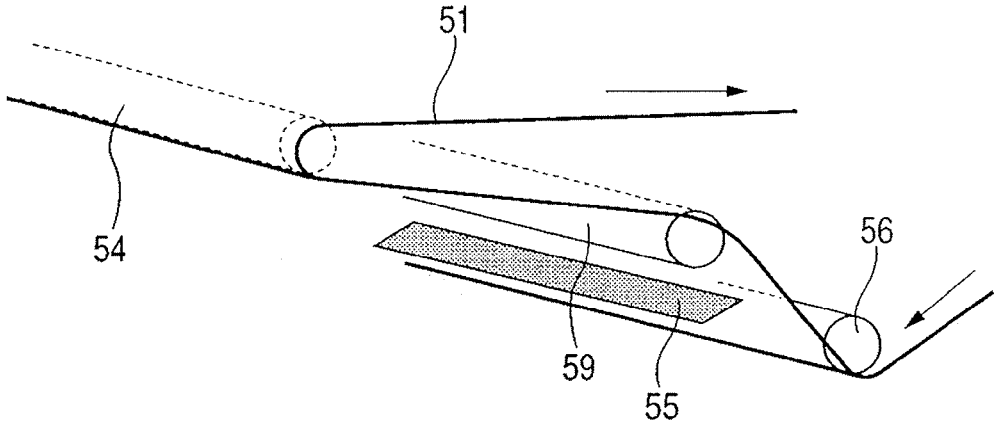
FIG. 6 is a diagram illustrating an inclination of the intermediate transfer belt in an edge portion of a bending member in an intermediate transfer unit of the image forming apparatus of the first embodiment.

Such a construction is used in the case where it is necessary to set the width of intermediate transfer belt 51 to be relatively larger than an image forming width. For example, there can be mentioned the case where a deviation of the intermediate transfer belt 51 is regulated by ribs 512 formed in the edge portions of the intermediate transfer belt 51 as illustrated in FIG. 5. FIG. 5 illustrates a side sectional view of the intermediate transfer belt 51 and the tension roller 54 in FIG. 2. The ribs 512 for the deviation regulation are formed in the edge portions of the intermediate transfer belt 51. The ribs 512 collide with tapered portions 541 in the edge portions of the tension roller 54, thereby regulating the deviation of the intermediate transfer belt 51.

In the above construction, a width of fouling which has been transferred and fixed to the edge portion of the intermediate transfer belt 51 is expressed by Lbt in FIG. 1. Further, to prevent the fouling in the edge portion of the intermediate transfer belt from being transferred and fixed to the bending roller 59, it is necessary that the width of bending roller 59 is smaller than that of the photosensitive drum cleaner blade 61, that is, it is necessary to satisfy the following relation.

(width Ldrcln of photosensitive drum cleaner blade)>(width Lr of bending roller)

The above relations are summarized as follows. That is, the respective members are constructed so as to satisfy the following relations.

(width Ldr of photosensitive drum)>(width Ldrcln of photosensitive drum cleaner blade), and (width Lb of intermediate transfer belt)>(width Ldrcln of photosensitive drum cleaner blade)>(width Lr of bending roller)

Thus, the edge portion in the width direction of the photosensitive drum cleaner blade 61 is located on the inner side of the edge portion in the width direction of the photosensitive drum 1. Further, the edge portion in the width direction of the bending roller 59 is located on the inner side of the edge portion in the width direction of the photosensitive drum cleaner blade 61. Moreover, the edge portion in the width direction of the photosensitive drum cleaner blade 61 is located on the inner side of the edge portion in the width direction of the intermediate transfer belt 51. Thus, it is possible to avoid such a situation that the toner fouling formed in the edge portions of the photosensitive drum is transferred to the bending roller 59 through the intermediate transfer belt. Such a phenomenon that the intermediate transfer belt 51 is damaged can be avoided.

Also in a mechanism for swinging the photosensitive drum cleaner blade 61 in the width direction or an image forming apparatus in which the intermediate transfer belt 51 swings in the width direction, (1) the edge portion of the photosensitive drum cleaner blade 61 is located on the inner side of the edge portion of the photosensitive drum 1. Further, (2) the edge portion of the bending roller 59 is located on the inner side of the edge portion of the photosensitive drum cleaner blade 61. Moreover, (3) the edge portion of the photosensitive drum cleaner blade 61 is located on the inner side of the edge portion of the intermediate transfer belt 51. By using such a construction, the above problem can be avoided.

In the embodiment, the width of bending roller 59 is set to be larger than a maximum image width Li of the image which is transferred onto the intermediate transfer belt 51. That is, as illustrated in FIG. 1, it is set so as to satisfy the following relation.

(width Lr of bending roller)>(maximum image width Li)

In FIG. 2, the image transferred onto the intermediate transfer belt 51 is transferred onto the recording material in the secondary transfer section. Thereafter, the transfer residual toner on the intermediate transfer belt 51 is removed and collected by the intermediate transfer belt cleaner 55. Further, the bending roller 59 for pressing and bending the intermediate transfer belt 51 from the outer peripheral surface is provided on the downstream of the intermediate transfer belt cleaner 55 in the rotating direction of the intermediate transfer belt 51. Since the bending roller 59 is arranged on the downstream of the intermediate transfer belt cleaner 55, the fouling by the transfer residual toner in the secondary transfer section can be avoided. However, although the transfer residual toner can be perfectly removed by the intermediate transfer belt cleaner 55, there is a case where an external additive agent which has externally been added to the toner cannot be completely removed.

As toner which is used here, one of a vinyl system resin, a phenol resin, a natural resin denatured phenol resin, a natural resin denatured maleic resin, an acrylate resin, a methacrylic resin, polyvinyl acetate, and a silicone resin is used as a toner host body. Further, one of a polyester resin, polyurethane, a polyamide resin, a furan resin, an epoxy resin, a xylene resin, polyvinyl butyral, a terpene resin, a coumarone-indine resin, and a petroleum system resin is used as a toner host body. The toner whose particle size is equal to about 5 to 10 μm is used.

As an external additive agent, one of an aluminum oxide, strontium titanate, titanium oxide, and silica micro powder can be mentioned. The external additive agent whose particle size is equal to about 30 to 300 nm is used. A part of the external additive agent dedoped from the toner host body passes through the intermediate transfer belt cleaner 55 because its particle size is small, remains on the intermediate transfer belt 51, and is pressed between the bending roller 59 and the intermediate transfer belt 51. Thus, the external additive agent is deposited onto the intermediate transfer belt 51 and exerts an influence on transfer performance.

That is, it has been found that in the region of the intermediate transfer belt 51 onto which the external additive agent has been deposited, mold release performance of the intermediate transfer belt 51 is improved, transfer performance in the primary transfer section deteriorates, and transfer performance in the secondary transfer section is improved.

The external additive agent which has passed through the intermediate transfer belt cleaner 55 and remains on the intermediate transfer belt 51 exists with the maximum image width Li. When the width Lr of bending roller 59 is smaller than the maximum image width Li, an amount of deposition of the external additive agent on the intermediate transfer belt 51 in the region where the external additive agent is not pressed is smaller than that in the region where it is pressed by the bending roller 59. Therefore, a degree of deposition of the external additive agent differs in the region of the maximum image width Li and the transfer performance in the image region differs.

In the embodiment, therefore, a construction in which an influence on the transfer performance due to the deposition of the external additive agent to the intermediate transfer belt 51 does not differ in the image region is used. That is, the width Lr of bending roller 59 is set to be larger than the maximum image width Li. Thus, the edge portion in the width direction of the maximum image which is transferred onto the intermediate transfer belt 51 is located on the inner side of the edge portion in the width direction of the bending roller 59. The external additive agent on the intermediate transfer belt 51 is uniformly pressed in the whole area of the image region. Thus, the transfer performance in the image region does not differ.

Further, in the embodiment, the width of intermediate transfer belt cleaner blade 551 is set to be smaller than the width of bending roller 59. That is, as illustrated in FIG. 1, those widths are set so as to satisfy the following relation.

(width Lr of bending roller 59)>(width Lbcln of intermediate transfer belt cleaner blade)

With such a construction, even in the case where the phenomenon in which the intermediate transfer belt 51 falls to the bending roller 59 side in the edge portion of the bending roller 59 occurs or in the case where the wrinkles of the intermediate transfer belt occur, the edge portion of the intermediate transfer belt cleaning member 55 is not influenced by them. The defective cleaning which is caused when the contact state of the intermediate transfer belt 51 and the intermediate transfer belt cleaning member 55 becomes unstable can be avoided.

Although the embodiment of the invention has been described with respect to the case where the cleaner blade is used as a cleaning member, the cleaning member is not limited to the blade shape but similar effects can be also obtained in the case of using a fur brush.

[Comparison]

Comparison with a construction different from that of the embodiment will now be described. An image forming apparatus according to Comparison has almost the same construction as that of the embodiment except that the widths of the respective members are set so as to satisfy the following relations.

(width Ldr of photosensitive drum)>(width Ldrcln of photosensitive drum cleaner blade) and (width Lb of intermediate transfer belt)>(width Lr of bending roller)>(width Ldrcln of photosensitive drum cleaner blade)

Figure 7:
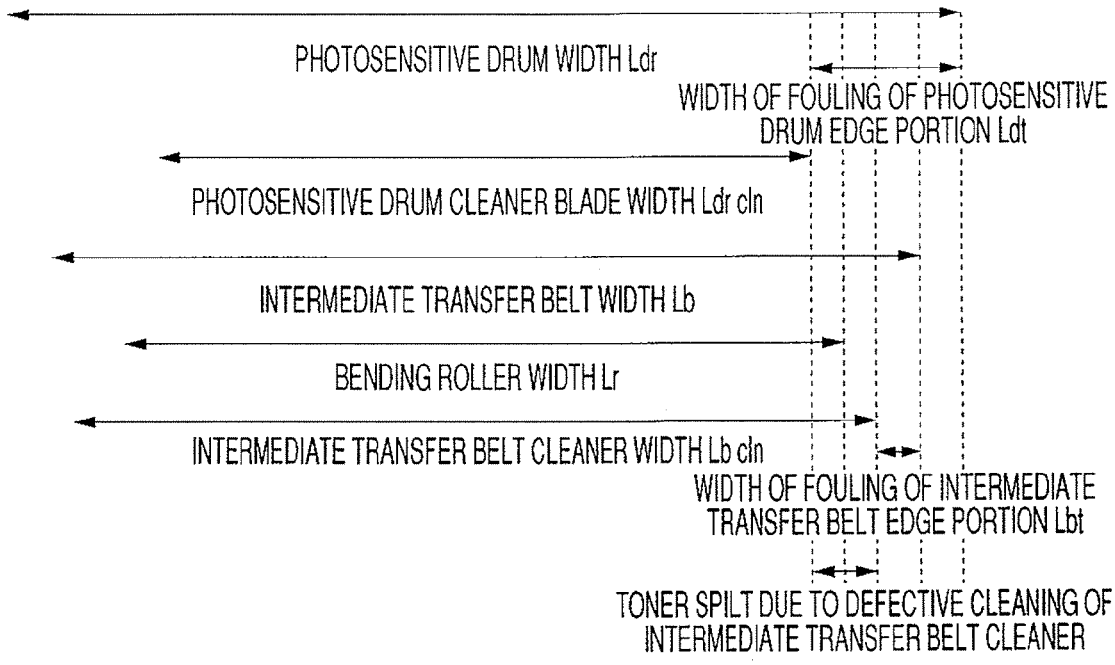
FIG. 7 is a diagram illustrating relations among widths of members of an image forming apparatus of Comparison.
Figure 8:
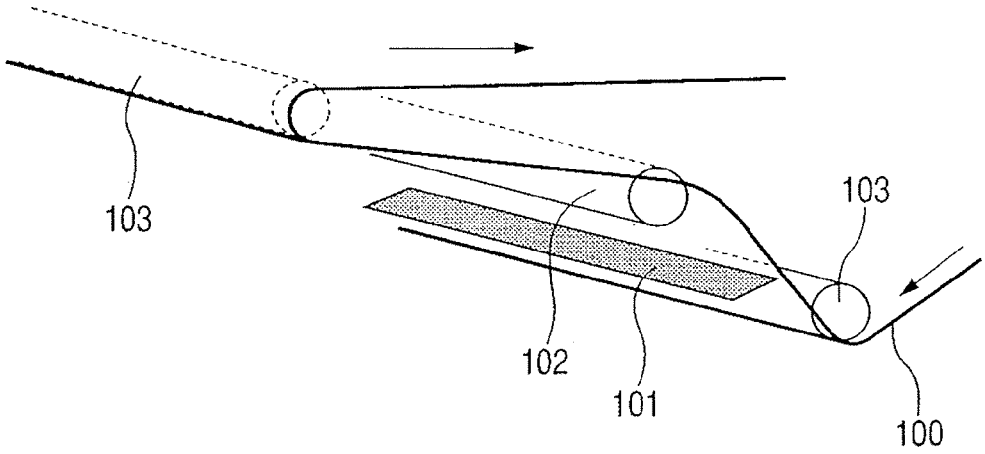
FIG. 8 is a diagram illustrating an inclination of an intermediate transfer belt in an edge portion of a bending member in an intermediate transfer unit of a conventional image forming apparatus.

Those relations are illustrated in FIG. 7. Those relations differ from those in the foregoing embodiment with respect to a point that the relation between the width of bending roller 59 and the width of photosensitive drum cleaner blade 61 is reversed.

Thus, the fouling of the edge portion of the photosensitive drum appears in the edge portion of the bending roller 59. Therefore, the toner fouling is transferred and deposited onto the bending roller 59 and the intermediate transfer belt 51 is damaged.

Therefore, as shown in Japanese Patent Application Laid-Open No. 2003-149953 mentioned above, the width of intermediate transfer belt cleaner blade 551 is set so as to satisfy the relation of (width of intermediate transfer belt cleaner blade>width of bending member). Thus, the fouling of the edge portion of the intermediate transfer belt 51 is set to the width illustrated at Lbt in FIG. 7 and does not appear in the edge portion of the bending roller 59.

However, in the durability for a long period of time, the fouling of the edge portions of the photosensitive drums of four colors are continuously transferred onto the intermediate transfer belt. Therefore, a large quantity of fouled toner is supplied to the edge portion of the intermediate transfer belt cleaner blade 551 and the defective cleaning occurs in the edge portion of the intermediate transfer belt cleaner blade 551. Thus, the toner passes through the blade and pollutes the edge portion of the bending roller 59.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-046161, filed Feb. 23, 2006, which is hereby incorporated by reference herein in its entirety.

What is claimed is:

1. An image forming apparatus comprising:

an image bearing member which is rotated while bearing a toner image;

an intermediate transfer belt onto which the toner image is primary-transferred from the image bearing member and from which the toner image is secondary-transferred onto a recording material;

an image bearing member cleaning member which removes the toner from the image bearing member and whose length in a rotational axial direction of the image bearing member is shorter than the image bearing member; and a bending member which comes into contact with a surface of the intermediate transfer belt onto which the toner image is primary-transferred and which bends the intermediate transfer belt, wherein, in the rotational axial direction of the image bearing member, assuming that a length of the image bearing member cleaning member is set to Ldrcln, a length of the intermediate transfer belt is set to Lb, and a length of the bending member is set to Lr, there is a relation of Lb>Ldrcln>Lr.

2. An apparatus according to claim 1, wherein assuming that a length in a width direction of the maximum image which is transferred onto the intermediate transfer belt is set to Li, there is a relation of Lr>Li.

3. An apparatus according to claim 2, further comprising an intermediate transfer belt cleaning member which removes the toner on the intermediate transfer belt, and wherein assuming that a length of the intermediate transfer belt cleaning member is set to Lbcln, there is a relation of Lr>Lbcln.

4. An image forming apparatus comprising:

an image bearing member which is rotated while bearing a toner image;

an intermediate transfer belt onto which the toner image is primary-transferred from the image bearing member and from which the toner image is secondary-transferred onto a recording material;

an image bearing member cleaning member which removes the toner from the image bearing member and whose edge portion is located on an inner side of an edge portion of the image bearing member in a rotational axial direction of the image bearing member; and a bending member which comes into contact with a surface of the intermediate transfer belt onto which the toner image is primary-transferred and which bends the intermediate transfer bent, wherein in the rotational axial direction of the image bearing member, an edge portion of the bending member is located on an inner side of the image bearing member cleaning member and an edge portion of the image bearing member cleaning member is located on an inner side of an edge portion of the intermediate transfer belt.

5. An apparatus according to claim 4, wherein an edge portion of the maximum image which is transferred onto the intermediate transfer belt is located on an inner side of the edge portion of the bending member.

6. An apparatus according to claim 5, further comprising an intermediate transfer belt cleaning member which removes the toner on the intermediate transfer belt, and wherein an edge portion of the intermediate transfer belt cleaning member is located on an inner side of the edge portion of the bending member.

* * * * *